US009227315B2

(12) United States Patent
Hermansen et al.

(10) Patent No.: US 9,227,315 B2
(45) Date of Patent: Jan. 5, 2016

(54) MULTIPLE TOOL

(75) Inventors: Frank Hermansen, Laguna Beach, CA (US); Carl Winefordner, Laguna Beach, CA (US)

(73) Assignee: Crank Brothers, Inc., Laguna Beach, CA (US)

( * ) Notice: Subject to any disclaimer, the term of this patent is extended or adjusted under 35 U.S.C. 154(b) by 736 days.

(21) Appl. No.: 13/979,266

(22) PCT Filed: Apr. 1, 2010

(86) PCT No.: PCT/IB2010/051440

§ 371 (c)(1), (2), (4) Date: Jan. 2, 2014

(87) PCT Pub. No.: WO2011/121396

PCT Pub. Date: Oct. 6, 2011

(65) Prior Publication Data

US 2014/0102267 A1 Apr. 17, 2014

(51) Int. Cl.

| | |
|---|---|
| ***B25F 1/04*** | (2006.01) |
| ***B25G 1/08*** | (2006.01) |
| ***B25B 15/00*** | (2006.01) |
| ***B25B 27/00*** | (2006.01) |

(52) U.S. Cl.

CPC ..... *B25G 1/08* (2013.01); *B25B 15/008* (2013.01); *B25B 27/0071* (2013.01); *B25F 1/04* (2013.01)

(58) Field of Classification Search

CPC .... B25G 1/08; B25B 15/008; B25B 27/0071; B25F 1/04

USPC ..... 81/490

See application file for complete search history.

(56) References Cited

U.S. PATENT DOCUMENTS

| | | | | |
|---|---|---|---|---|
| 4,759,645 | A | 7/1988 | Kuo | |
| 5,450,774 | A | 9/1995 | Chang | |
| 6,112,351 | A | 9/2000 | Hawkins et al. | |
| 6,151,999 | A | 11/2000 | Eklind | |
| RE37,210 | E | 6/2001 | Chuang | |
| 6,868,760 | B1 | 3/2005 | Johnson | |
| 7,140,280 | B2 * | 11/2006 | Hawkins | B25B 13/56 7/138 |
| 7,281,456 | B2 * | 10/2007 | Chiang | B25B 15/008 7/138 |
| 7,481,137 | B1 | 1/2009 | Johnson | |
| 8,413,556 | B2 * | 4/2013 | Chuang | B25B 13/56 157/1.3 |
| RE44,675 | E * | 12/2013 | Hawkins | B25G 1/085 7/138 |
| 2005/0204721 | A1 | 9/2005 | Wu | |

FOREIGN PATENT DOCUMENTS

| | | |
|---|---|---|
| CH | 496517 | 9/1970 |
| DE | 2603672 | 8/1977 |
| DE | 29811831 | 9/1998 |
| DE | 202007014261 | 12/2007 |
| WO | WO 01/12390 | 2/2001 |

* cited by examiner

*Primary Examiner* — David B Thomas

(74) *Attorney, Agent, or Firm* — Haynes and Boone, LLP

(57) ABSTRACT

Multi-tool, including at least one pivot (2, 3, 202, 302) on which are articulated a plurality of implements (4, 5, 6, 104, 204, 205, 304, 305) each rotatable from a minimum size inactive position to at least one operating position, characterized in that said pivot (2, 3, 202, 302) comprises elastic retaining means (9) of at least one of these implements (4, 5, 6, 104, 204, 205, 304, 305) in operating position and/or in the minimum encumbrance position.

18 Claims, 7 Drawing Sheets

MULTIPLE TOOL

TECHNICAL FIELD OF THE INVENTION

The present invention relates to a multiple tool. More specifically, this invention relates to a multiple tool for the maintenance and repair of motorcycles, cycles and the like, and their mechanical parts.

STATE OF THE ART

Multiple tools are known, particularly of the pocket type and then rather small, which allow the user to bring together in one portable object a number of implements, each one for a different use. Some examples of these implements are wrenches, allen keys, screwdrivers, and the like. Some known types of multiple tools are especially dedicated to the care, maintenance and repair of mechanical parts for cycles and motorcycles. The user can then bring with himself the multiple tool, for example, when making excursions or trips by bicycle or motorcycle, so he can work out emergency situations, such as mechanical damage to the medium, boring tire punctures, and more; alternatively, the multi-tool can be simply used to make quick adjustments on the medium itself, such as raise or lower the saddle, mount or dismount accessories, and so on.

Multiple tools of known type generally comprise a pivot around which said implements, adjancent one another, are rotatable from a minimum encumbrance retracted position to an operating position: this operating position is reached by manually rotating the implement around the pivot, starting from the retracted position, by a certain angle comfortable enough to use the implement by gripping the multi-tool.

In these multiple tools each implement, when used, is retained in the minimum encumbrance retracted position simply by friction; in other types of tools a case is used for containing the implements, and for preventing the implements from accidentally moving from the retracted position.

Either one or the other solution is not without drawbacks. The first solution is unable to ensure that implements are maintained in the retracted position; rather, they tend to rotate accidentally bothering the user, who often keep the multiple tool inside a shirt pocket, or in other pockets of sports clothings.

The second solution is cumbersome and impractical, since the user must, each time, remove the case from the multiple tool to be able to use it, and then store the same at the end of use: also it forces the user to take care of the case, not to lose it.

PURPOSES OF THE INVENTION

The aim of the present invention is therefore to improve the state of the art, developing a multiple tool with more reliable, practical and safer use than the tools of the known type, in particular as to prevent effectively the various implements to accidentally move when not used.

This aim is achieved by the multiple tool according to the attached claim 1.

The presence of elastic retention means in the multiple tool according to the present invention allows maintaining all implements, when not used, in the respective minimum encumbrance position in a stable and secure way; furthermore, said elastic retention means permit, at the same time, to bring each implement simply and easily from the minimum encumbrance position to the operating positions, which are, likewise, held in a secure and stable way. Further advantageous features are described in the dependent claims.

BRIEF DESCRIPTION OF THE DRAWINGS

These and other advantages will be better understood by any man skilled in the art from the following description that follows and from the attached drawings, given as a non-limiting example, in which.

EMBODIMENTS OF THE INVENTION

Figure 1:
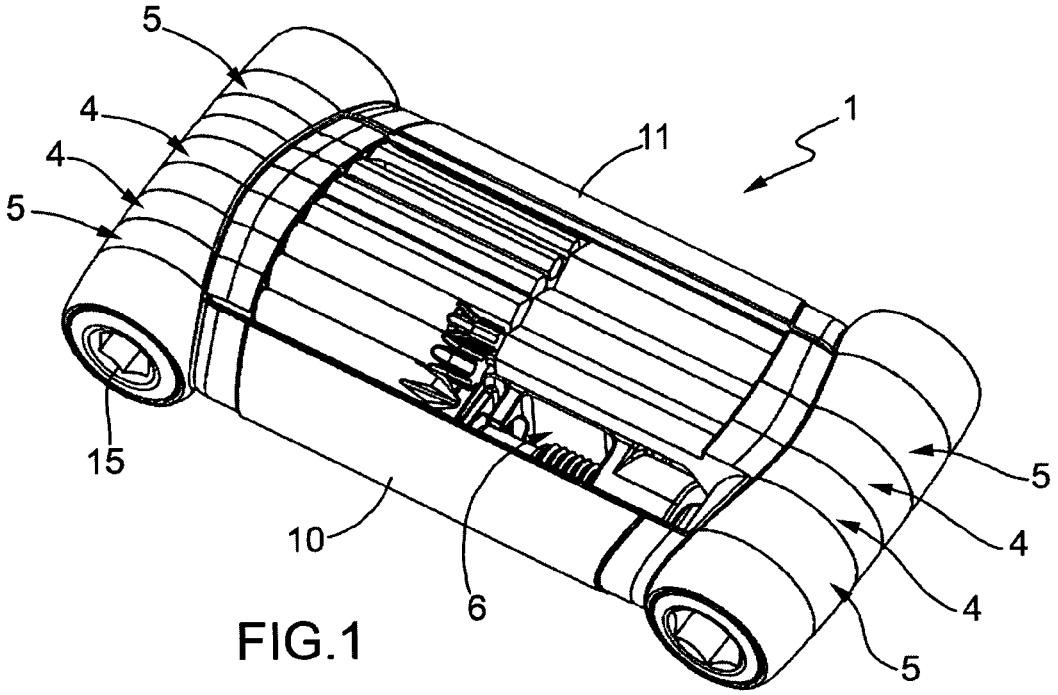
FIG. 1 is a perspective view of the multiple tool according to the invention.

With reference to the schematic representation of FIG. 1, a multiple tool according to the invention is wholly indicated with 1.

In the following embodiments individual characteristics, given in connection with specific embodiments, may actually be interchanged with other different characteristics that exist in other embodiments.

The multiple tool according to the present invention, which will be described below in its embodiments, is directed, particularly but not exclusively, to be used by bicycles and motorcycles users and the like, to perform maintenance and repairs on them. Other uses of this multiple tool can be provided without any limitation for the aims of this invention.

The multiple tool 1 according to the present invention includes at least one pivot 2, 3, along which are articulated a plurality of implements 4, 5, 6, each one being rotatable from a minimum encumbrance inactive position to at least one operating position. For minimum encumbrance inactive position must be understood, as clearly visible in the figures, a position in which each implement 4, 5, 6 is included in the outline of multiple tool 1, without projecting outwards.

Figure 2:
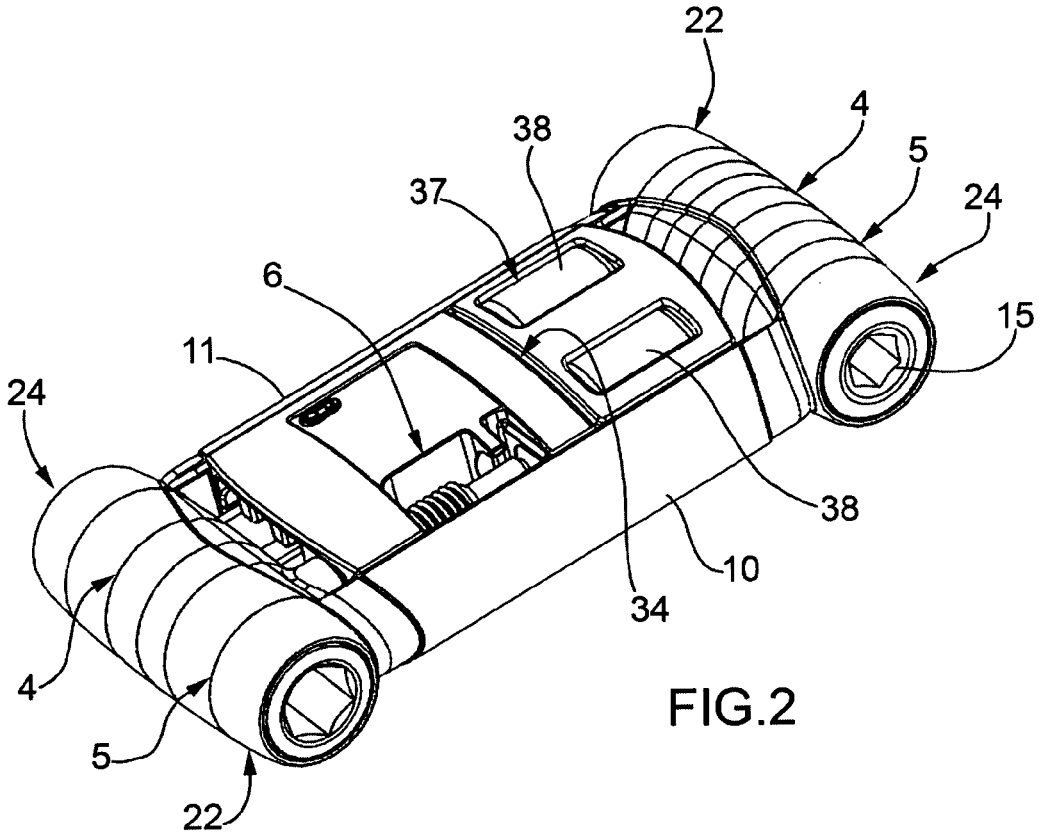
FIG. 2 is a perspective bottom view of the multiple tool.
Figure 4:
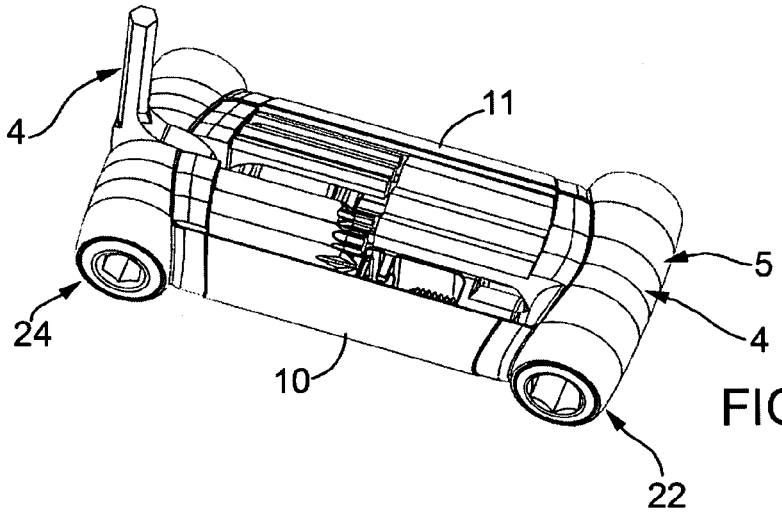
FIG. 4 is a top perspective view of the multiple tool with one of the implements in an operating position.
Figure 5:
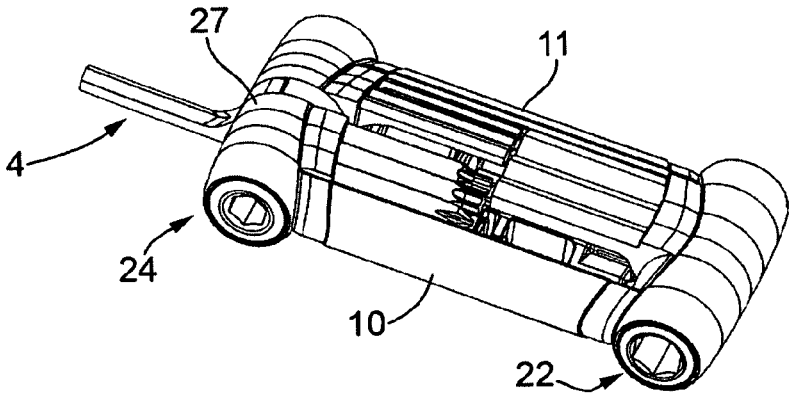
FIG. 5 is a perspective view of the multiple tool with the implement in another operating position.
Figure 6:
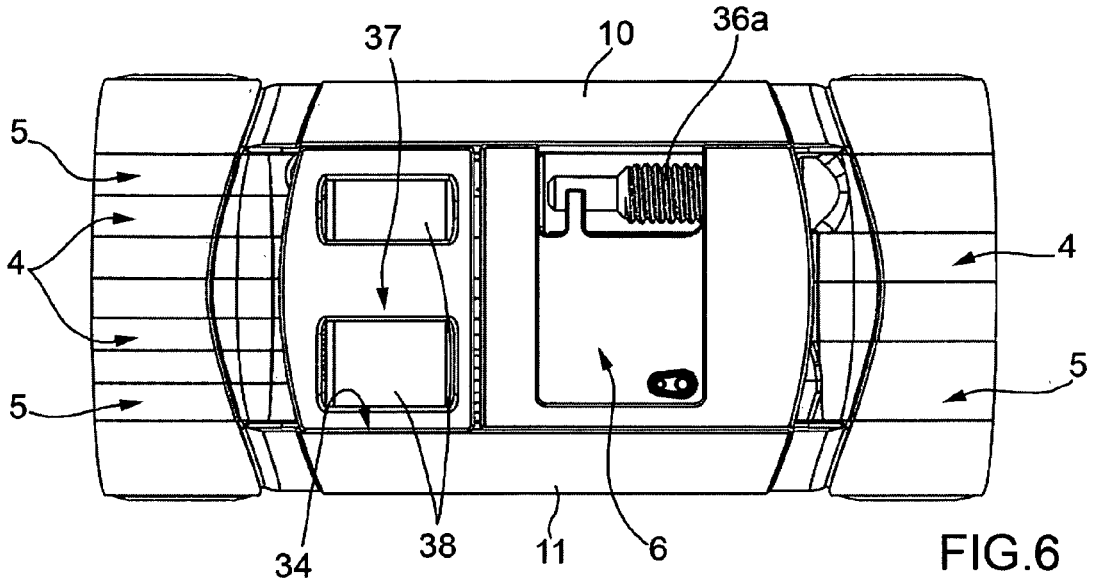
FIG. 6 is a bottom view of the multiple tool.
Figure 7:
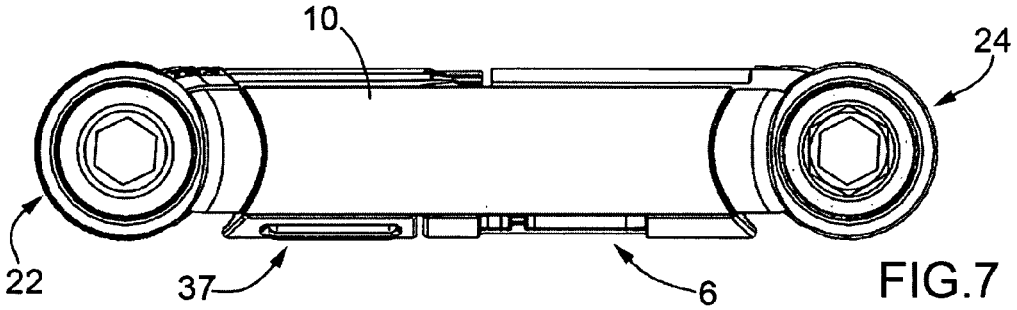
FIG. 7 is a side view of the multiple tool.
Figure 8:
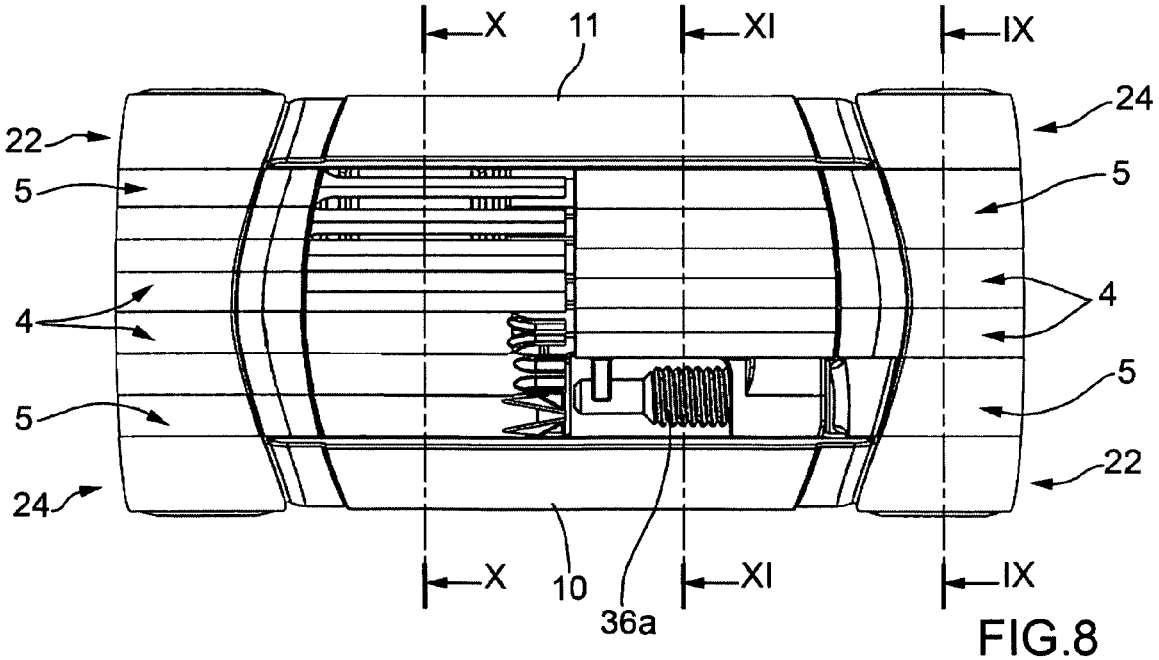
FIG. 8 is a top view of the multiple tool.

More specifically, as will appear from the description hereinafter, the multiple tool 1 of this embodiment includes a first and a second pivot 2, 3, parallel to each other, on which are articulated respective pluralities of implements 4, 5, 6, each one rotatable from a minimum encumbrance inactive position to at least one operating position. Both the first and the second pivots 2, 3 are respectively provided with a first end 7 and an opposing second end 8. In FIGS. 1, 2, as also in FIGS. 6, 7, 8, all the implements 4, 5, 6 of the multiple tool 1 are represented in the respective positions of minimum encumbrance, while in the FIGS. 4, 5 an implement is represented, for instance constituted by an allen wrench, in two different operating positions, in relationship to the different direction of handling, frontal or perpendicular, preferred by the user. Every pivot 2, 3 includes respective elastic retention means, globally pointed with 9, of at least one of said implements 4, 5, 6 in the respective operating position and/or of minimum encumbrance. More in detail, every pivot 2, 3 includes respective elastic retention means 9 of all the implements 4, 5, 6 mounted on the multiple tool 1, in the respective operating positions and in the respective positions of minimum encumbrance, with the technical advantages that will appear clearer in the sequel. The multiple tool comprises connecting means 10, 11 of the first pivot 2 to the second pivot 3, that will be described better in the sequel, to realize a compact and solid structure, as visible in FIGS. 1, 2 and following.

Figure 3:
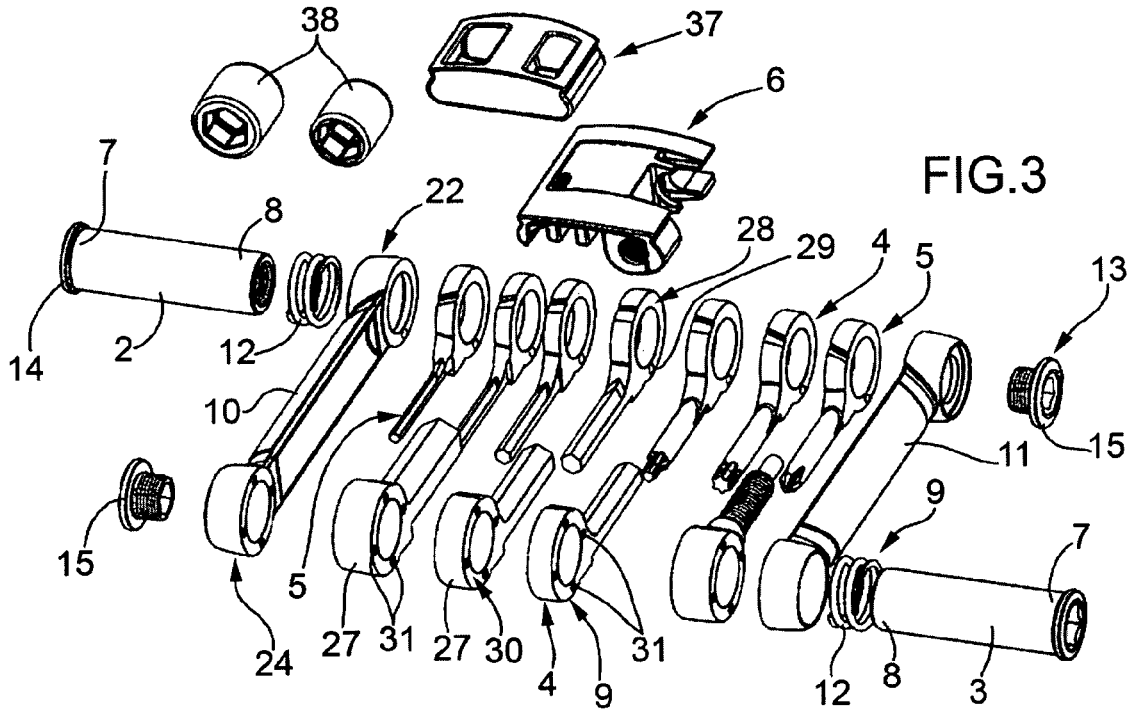
FIG. 3 is an exploded perspective view of the multiple tool.
Figure 9:
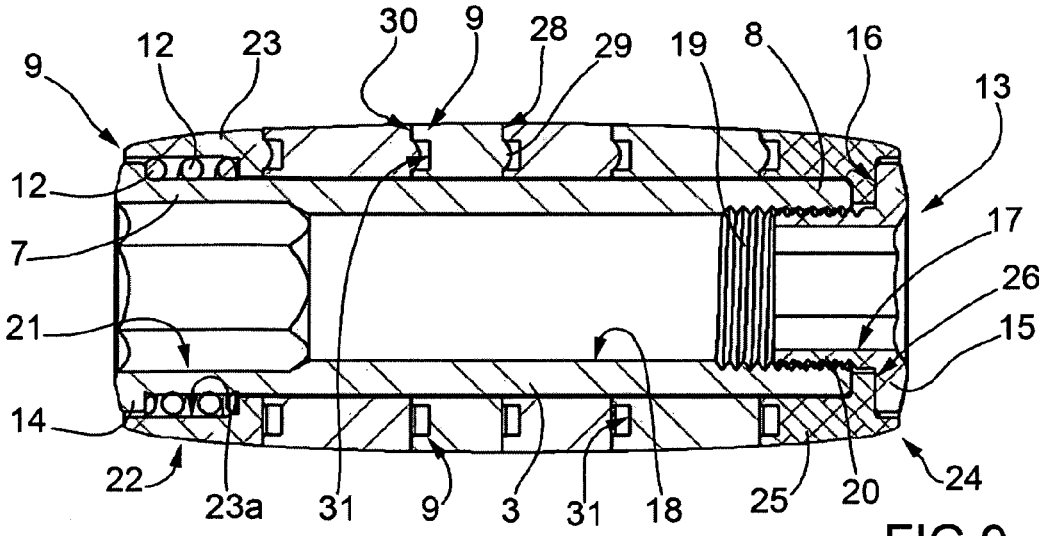
FIG. 9 is a section of the multiple tool according to plane IX-IX of FIG. 8.

Referring now particularly to FIG. 3 and to FIG. 9, in which a section of the multiple tool is represented in correspondence of the second pivot 3, the elastic retention means 9 include, for both the first pivot 2 and second pivot 3, a compression spring 12 resting upon the first extremity 7 of the first pivot 2 and of the second pivot 3, and clamping means 13 of the implements 4, 5, 6 along the first pivot 2 and the second pivot 3 against the respective compression spring 12. More particularly, each compression spring 12 rests upon a respective collar 14 provided in the first extremity 7 of each pivot 2, 3.

For a best understanding of the description, and as well visible in FIG. 3, it is pointed out that the first extremities 7 of first pivot 2 and of the second pivot 3 are placed opposed each other and not side by side, so that the respective compression springs 12 are placed by opposite sides, essentially to get a better assemblage and dismantlement of the multiple tool. Another purpose is that bars 10 and 11 are the same as each other, which is simpler in construction. The aforesaid clamping means 13 include particularly, for both the first pivot 2 and the second pivot 3, a bushing 15 screwed on the second extremity 8 of the first pivot 2 and the second pivot 3; each bushing 15 is provided with a respective compression surface 16 of the implements 4, 5, 6 against the respective compression spring 12, the latter being mounted with a certain preloading. Each bushing 15 is provided with an hexagonal recess 17 for the assemblage and the dismantlement of the multiple tool 1.

It is pointed out that the first pivot 2 and the second pivot 3 have both tubular conformation defining an inner surface 18 in which, in correspondence of the respective second extremity 8, an internal thread 19 is provided for the screwing of a respective external thread 20 provided in the bushing 15.

In correspondence of the first extremity 7 of each pivot 2, 3 is further provided ad hexagonal recess 21 for the assemblage and the dismantlement of the multiple tool 1. The particular tubular conformation of the pivots 2, 3 allow the multiple tool 1 to be definitely lighter than the multiple tools of the traditional type, with advantages of practicality of transport and employment. The elastic retention means 9 further include, for both the first pivot 2 and the second pivot 3, a first closing element 22 of the implements 4, 5, 6, interposed between a terminal implement 5 and the respective compression spring 12.

The first closing element 22 includes a first bushing body 23 provided with a resting surface 23*a* for the terminal coil of the respective compression spring 12. Said elastic retention means 9 also include a second closing element 24 of the implements 4, 5, 6, interposed between a terminal implement 5 and the compression surface 16 of the respective bushing 15, as clearly visible in FIG. 9. The second closing element 24 includes a second bushing body 25 provided with a lodging 26 for the respective bushing 15, on which, particularly, the compression surface 16 rests. Referring again to FIGS. 3 and 9, the elastic retention means 9 include, for each of the implements 4, 5, 6 of the multiple tool 1, an anular body 27 inserted along the first pivot 2 or the second pivot 3. Such anular body 27 has a first face 28 provided with a bump 29, and a second face 30, opposed to the first face 28, provided with a plurality of recesses 31. The bumps 29 of the implements 4, 5, 6 are substantially spherical cap shaped. By way of example, said recesses 31 are in number of four, 90° angularly spaced one from the other, with the advantages that will result clearer in the sequel. Evidently, the number of the recesses 31 can be any, without limitations, in relationship to the specific demands of employment. As it is clearly observed in FIG. 9, in this way a connection of implements 4, 5, 6 is realized along each pivot 2, 3, distinguished by the fact that the bump 29 of each implement 4, 5, 6 is selectively engaged, and elastically held in position by the action of the compression spring 12, in one of the recesses 31 of the adjacent implement. The engagement of the bump 29 in a recess 31 or in another recess 31 evidently corresponds, by choice of the user, to the position of minimum encumbrance, which is included within the outline of the multiple tool, or to one of the operating positions, for instance perpendicular to the tool 1, or aligned to it, etc. Furthermore, the presence of a certain number of recesses 31 allows the user to move, in the operating position, contemporarily two adjacent implements 4, 5, 6.

Regarding the terminal implements 5 of each pivot 2, 3, the afore mentioned connection is realized as it follows.

The first closing element 22 of one of the pivots 2, 3 includes a respective first base 32 provided with a bump 29 suitable to selectively engage one of the recesses 31 of the terminal implement 5.

The first closing element 22 of the other one of the pivots 2, 3 has a first base 32 provided, on the other hand, with a plurality of recesses 31 which are suitable to be selectively engaged by the bump 29 of the terminal implement 5.

In the same way, the second closing element 24 of one of the pivots 2, 3 includes a respective second base 33 provided with a plurality of recesses 31 which are suitable to be selectively engaged by the bump 29 of the terminal implement 5; the second closing element 24 of the other one of the pivots 2, 3 includes a respective second base 33 provided with a bump 29 suitable to selectively engage one of the recesses 31 of the terminal implement 5.

Figure 12:
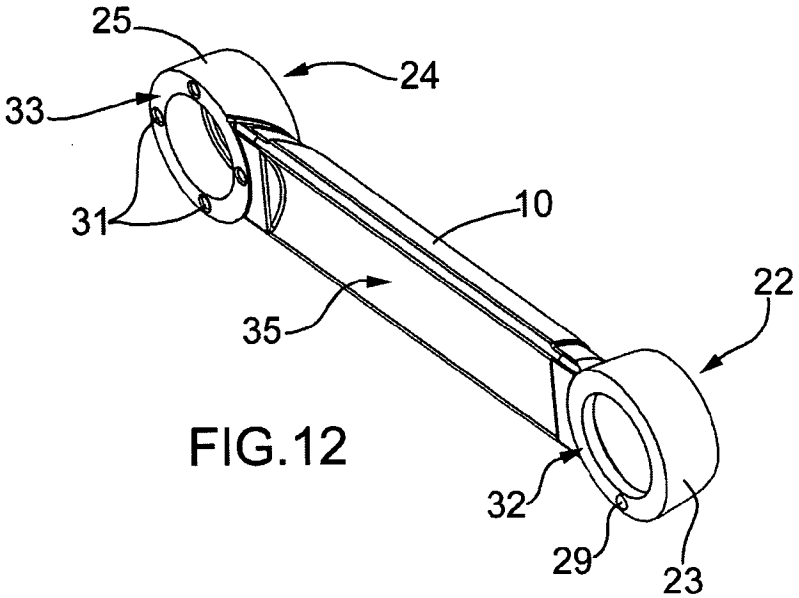
FIG. 12 is a perspective view of a detail of the multiple tool.

This conformation, which is essentially mirror-type, is understandable by observing FIG. 12, where the first closing element 22 of the two pivots 2, 3 are represented, connected by the connection means 10. As it is clearly noticed, the two first closing elements 22 have the first base 32 respectively provided with a bump 29, to a side, and with recesses 31, to the other side.

In the second closing elements 24 a conformation is realized that is, evidently, identical to that represented in FIG. 12.

The connection means 10, 11 of the first pivot 2 to the second pivot 3 include particularly a first bar 11, which rigidly connects the first closing element 22 of the first pivot 2 to the first closing element 22 of the second pivot 3.

Furthermore, the aforesaid connection means 10, 11 include a second bar 11 which rigidly connects the second closing element 24 of the first pivot 2 to the second closing element 24 of the second pivot 3.

The first bar 10 and the second bar 11 include a receptacle 34 for further implements or other objects.

The receptacle 34 is constituted by concave seats 35 provided in the first bar 10 and in the second bar 11.

Figure 13:
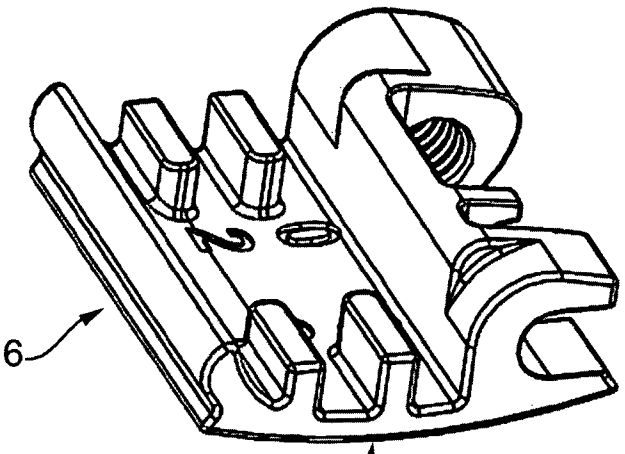
FIG. 13 is a detail perspective view of one of the implements of the multiple tool.

Regarding the implements 4, 5, 6, one of them is constituted by a chain breaker 6, of the known type. As it can be observed in FIG. 13, the chain breaker is provided with a curved shell 36 which is screwed to a suitable screw 36*a* coupled to one of the pivots 2, 3, through a respective anular body 27.

The curved shell 36, in its position of minimum encumbrance, joins the external surface of the first bar 10 and of the second bar 11, as visible for instance in FIG. 2, in such a way to create a continuous surface without edges or steps.

Figure 14:
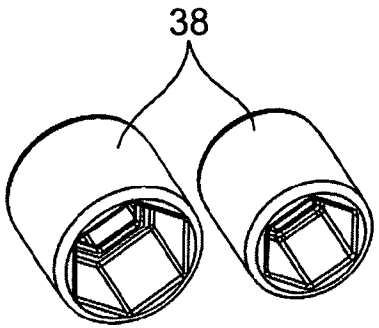
FIG. 14 is a detail perspective view of another implement of the multiple tool.
Figure 14:
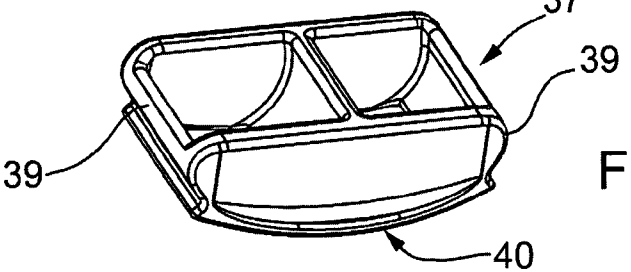

Furthermore the multiple tool includes a socket holder 37, visible in the detail of FIG. 14, in which two sockets 38 with different dimensions are also visible.

The socket holder 37 includes detachable fixing means 39 to the receptacle 34 provided in the multiple tool 1.

Figure 10:
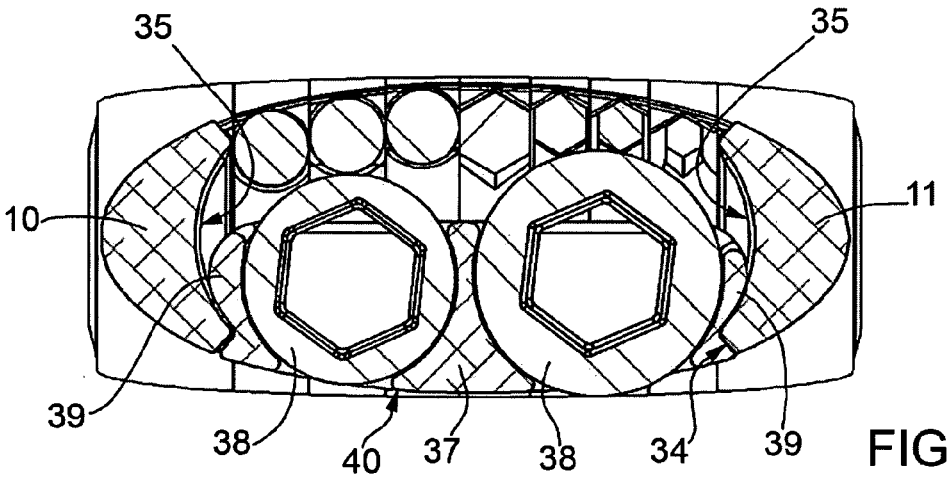
FIG. 10 is a section of the multiple tool according to plane X-X of FIG. 8.

As visible particularly also in FIG. 10, the detachable fixing means 39 of the socket holder 37 include two protruding convex sides 39, that are suitable to detachably engage the receptacle 34, that is in other words the concave seats 35 provided in the first bar 10 and in the second bar 11. The socket holder 37 can be freely extracted by practicing a light traction to slightly widen the edges of the concave seats 35. In the same way, a light manual pressure allows to put the socket holder 37 back in the position of minimum encumbrance.

Furthermore, the socket holder 37 includes a curved surface 40 that, in position of minimum encumbrance, joins the external surface of the first bar 10 and of the second bar 11, in such a way to realize a continuous surface without edges or steps.

Different kinds of objects, of specific employ for the maintenance of the cycle or motorcycle but also of different employ, can also be lodged in the receptacle 34.

Figure 11:
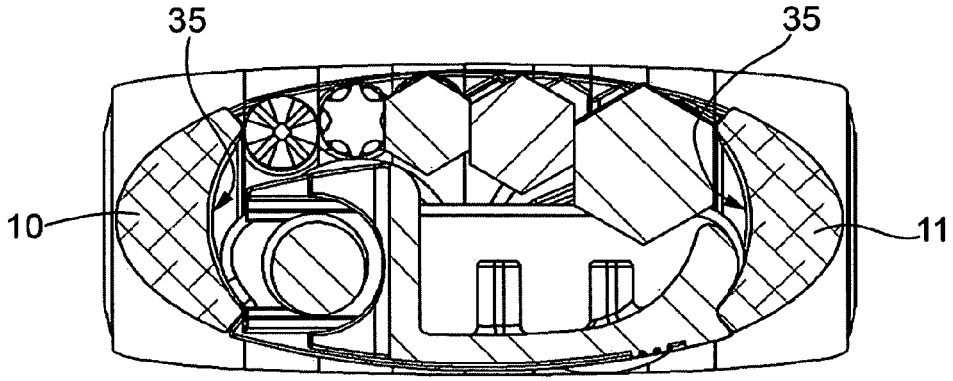
FIG. 11 is a section of the multiple tool according to plane XI-XI of FIG. 8.

The remaining implements 4, 5, as visible for instance in FIG. 3, but also in the section of FIG. 11, are constituted by allen wrenches, screw drivers, or similar. The implements 4, 5 can be of any kind, without limitations.

In use, each implement 4, 5, 6, articulated to the pivots 2, 3, can be brought by the respective position of minimum encumbrance to one or more operating positions, that are absolutely stable during the employment, with a simple manual rotation, that must be realized with an enough strength to free the bumps 29—of the employed implement and of the adjacent one—from the recesses 31 in which are engaged. Such strength, in practice, must permit a light axial movement of the package of implements 4, 5, 6, in a verse or in the other, to free the bumps 29: such movement is opportunely contrasted by the action of the compression spring 12 preloaded by the screwing of the bushing 15.

Once the employment of the implement 4, 5, 6 is finished, a simple manual rotation in the opposite sense allows to put it back in the position of minimum encumbrance, which is absolutely stable: such position is reached when the bumps 29, of the implement in use or of adjacent one, they engage again in the respective recesses 31. To get this result it is necessary that the package of implements 4, 5, 6 carries out a light movement along the pivot 2, 3, contrasted by the compression spring 12.

It can be seen that the invention reaches the proposed purposes.

When the multiple tool 1 is not employed, the implements 4, 5, 6 are firmly held in the respective positions of minimum encumbrance, without risks of accidental moves; furthermore, the implements are also firmly held in one of the respective operating positions, to allow the user to carry out any type of operation and handling in a sure and effective way.

Besides, more implements, also the adjacent ones, can firmly be held in the respective operating positions.

Figure 15:
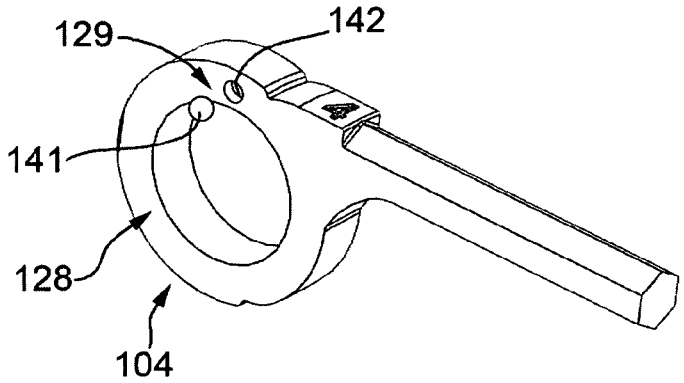
FIG. 15 is a detail perspective view of one of the implements of the multiple tool, in another embodiment.

Another embodiment of the multiple tool according to the present invention is represented in the detail of FIG. 15. In this embodiment, the parts that correspond to those of the preceding embodiment are indicated with the same reference numbers, increased by 100 unities.

FIG. 15 shows, in particular, one of the implements 104 of the multiple tool. The remaining parts of the tool are not described and represented, since they are identical to those of the preceding embodiment. In this embodiments, the bumps 129 are constituted by a sphere 141 which is engaged in a respective seat 142 provided in the first face 128.

This embodiment of the invention is of cheaper construction, since it is not necessary to realize a bump in each implement, but only a seat 142, that can be realized contextually to the realization of the recesses.

Figure 16:
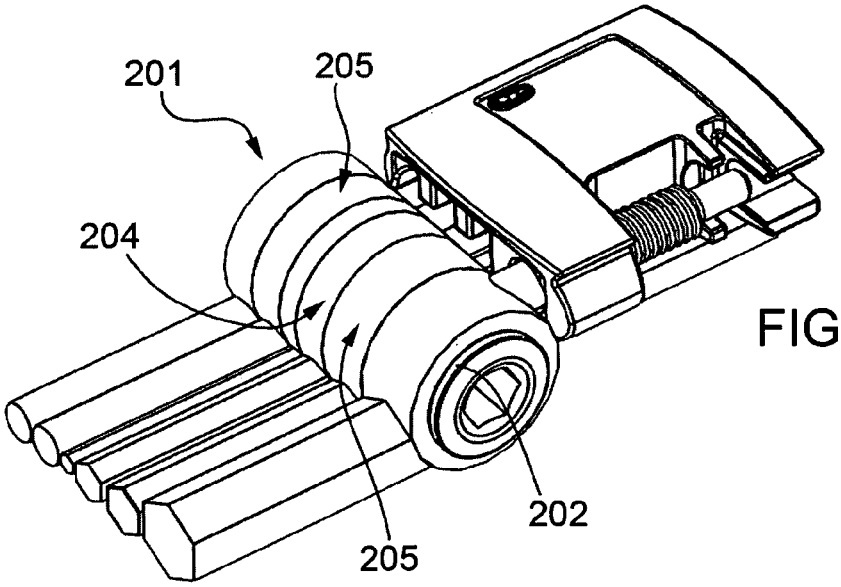
FIG. 16 is a top perspective view of yet another embodiment of the multiple tool according to the present invention.
Figure 17:
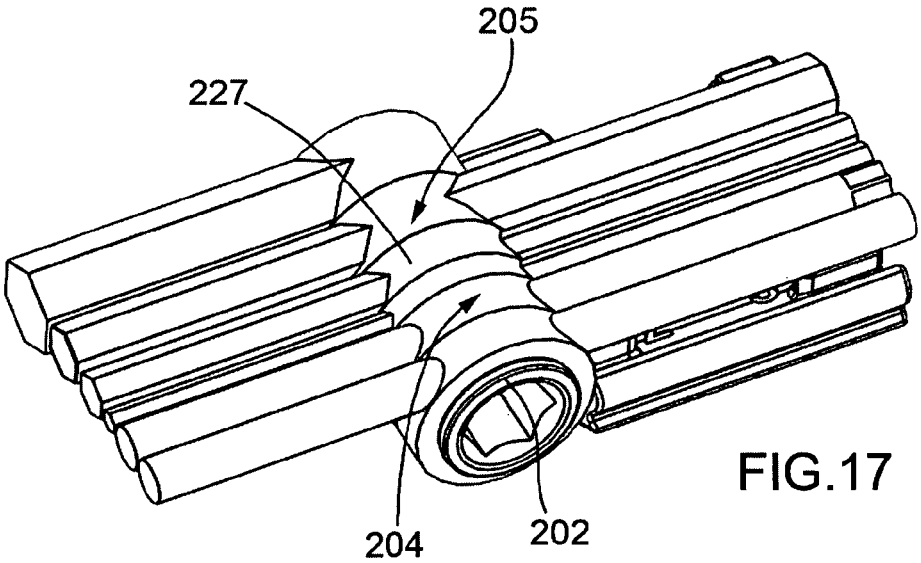
FIG. 17 is a bottom perspective view of the multiple tool of FIG. 16.
Figure 18:
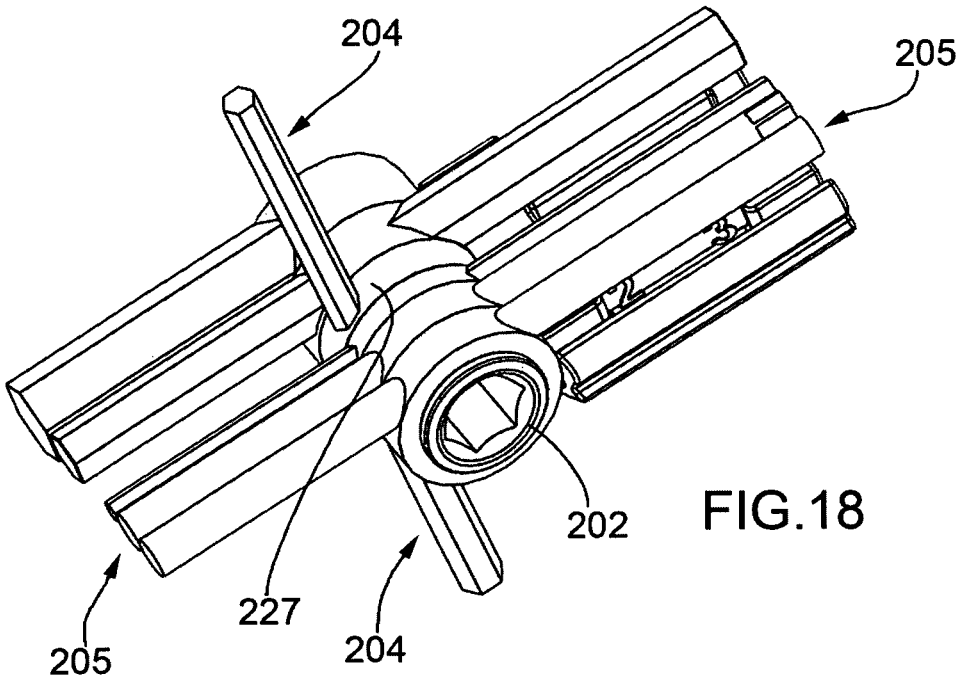
FIG. 18 is a bottom perspective view of the multiple tool of FIGS. 16, 17, with one of the implements in an operating position.

Another embodiment of the multiple tool 201 according to the present invention is shown in FIGS. 16, 17, and 18. In this embodiment, the parts that correspond to those of the preceding embodiment are indicated with the same reference numbers, increased by 100 unities.

Particularly, FIGS. 16 and 17 refer to a situation in which all the implements 204, 205 are in the respective position of minimum encumbrance, while FIG. 18 refers to a situation in which one of the implements 204 is in its operating position.

In this embodiment the multiple tool 201 includes just one pivot 202, while each anular body 227 articulated to the pivot 202 includes at least two implements 204 205. In this embodiment, therefore, the multiple tool 201 is structurally simpler and therefore cheaper than that of the preceding embodiment; at the same time, however, it includes a sufficient number of implements 204, 205 thanks to the fact that at least two implements 204, 205 are fixed on a same anular body 227.

Figure 19:
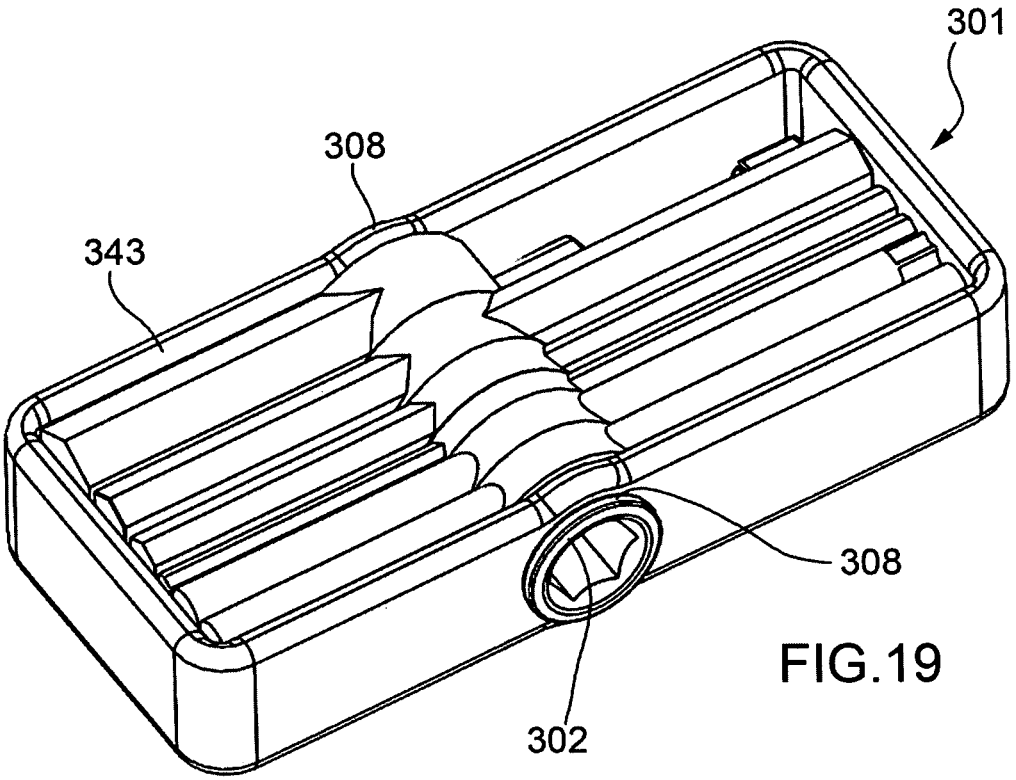
FIG. 19 is a perspective view of another embodiment of the multiple tool according to the present invention.

Still another embodiment of the multiple tool 301 according to the present invention is shown in FIG. 19. In this embodiment, the parts that correspond to those of the preceding embodiment are indicated with the same reference numbers, increased by 100 unities.

In this embodiment, the multiple tool 301 includes just one pivot 302, as in the preceding embodiment; the multiple tool 301 includes besides an handle 343 connected to at least one of the extremities 307, 308 of the pivot 302. More in detail, the handle 343 has closed shape and is fixed to the pivot 302 in correspondence of the first extremity 307 and of the second extremity 308. The handle 343 is fixed to the first closing element 322 and to the second closing element 324 of the pivot 302. The presence of the handle 343 allows the multiple tool 301 to be employed in a more effective and comforting way without substantial increase of weight or encumbrances. The present invention has been described according to preferred embodiments, but equivalent variants can be devised without departing from the scope of protection offered by the following claims.

The invention claimed is:

1. A multiple tool, comprising:

a pivot having a first end and a second end;

a plurality of implements, each comprising an opening through which the pivot engages, wherein each of the implements is rotatable about the pivot from an inactive position to an operating position;

a clamping means located at the first end of the pivot comprising a bushing screwed to the first end of the pivot, wherein the bushing comprises a compression surface; and an elastic retention means comprising:

a compression spring located at the second end of the pivot when engaged by the implements;

a first closing element interposed between an end one of the implements and the compression spring; and a second closing element interposed between the end one of the implements and the compression surface of the bushing.

2. The multiple tool of claim 1, further comprising a collar at the second end of the pivot for engaging with the compression spring.

3. The multiple tool of claim 1, wherein the first closing element comprises a first bushing body having a resting surface for a terminal coil of the compression spring.

4. The multiple tool of claim 1, wherein the second closing element comprises a second bushing body having a lodging for the bushing on which rests the compression surface.

5. The multiple tool of claim 1, wherein for each of the implements, the elastic retention means comprises:

an anular body mounted along the pivot;

a first face comprising a bump; and a second face opposed to the first face and comprising a plurality of recesses.

6. The multiple tool of claim 5, wherein the bump comprises a sphere engaged in a corresponding seat in the first face.

7. The multiple tool of claim 5, wherein the first closing element comprises a first base having a bump configured to selectively engage in one of the plurality of recesses of an end implement or having a plurality of recesses configured to be selectively engaged by the bump of an end implement.

8. The multiple tool of claim 7, wherein the second closing element comprises a second base having a plurality of recesses configured to be selectively engaged by the bump of an end implement or having a bump configured to selectively engage one of the plurality of recesses of an end implement.

9. The multiple tool of claim 5, wherein the plurality is four and the recesses are spaced 90° apart.

10. The multiple tool of claim 1, wherein the pivot comprises a tubular portion defining an inner surface in which an internal thread is provided for the screwing of a corresponding external thread in the bushing.

11. The multiple tool of claim 1, further comprising a handle connected to at least one of the first end and the second end of the pivot.

12. The multiple tool of claim 11, wherein the handle is connected to the first end and the second end of the pivot.

13. The multiple tool of claim 1, further comprising a second pivot parallel to the pivot from which at least one of the plurality of implements is rotatable thereon.

14. The multiple tool of claim 13, wherein the second pivot comprises an elastic retention means.

15. The multiple tool of claim 13, further comprising connection means for connecting the pivot to the second pivot.

16. The multiple tool of claim 15, wherein the connection means comprises a first bar that rigidly connects the first closing element of the pivot to a first closing element of the second pivot.

17. The multiple tool of claim 16, wherein the connection means comprises a second bar that rigidly connects the second closing element of the pivot to a second closing element of the second pivot.

18. The multiple tool of claim 1, wherein each of the plurality of implements comprises an annular body articulated to the pivot.

* * * * *